United States Patent [19]

Farago et al.

[11] 4,022,569

[45] May 10, 1977

[54] CALCINATION OF COKE

[75] Inventors: Frank John Farago; Dale Gordon Retallack; Raman Radha Sood, all of Jonquiere, Canada

[73] Assignee: Alcan Research and Development Limited, Montreal, Canada

[22] Filed: Dec. 5, 1975

[21] Appl. No.: 638,285

[52] U.S. Cl. ..... 432/14; 201/32; 432/17; 432/51

[51] Int. Cl.[2] ..... F27B 15/00; F27B 15/10

[58] Field of Search ..... 432/14, 17, 36, 45, 432/51; 201/32

[56] References Cited

UNITED STATES PATENTS

| | | | |
|---|---|---|---|
| 3,888,621 | 6/1975 | Williams | 432/36 |
| 3,966,560 | 6/1976 | Farago et al. | 201/32 |

*Primary Examiner*—John J. Camby
*Attorney, Agent, or Firm*—Copper, Dunham, Clark, Griffin & Moran

[57] ABSTRACT

In the calcination of petroleum coke or the like in a rotary kiln, utilizing controlled air supply intermediate the ends of the kiln to burn removed volatiles and thereby generate all or nearly all of the heat required, highly effective control procedure includes establishing and repeatedly re-establishing target values for temperatures of exit gas and discharging product respectively at opposite ends of the kiln, such target temperatures representing conditions of desired position of the calcining zone and desired physical character of the calcined product which is achieved by proper maximum temperature in said zone. The procedure further includes adjusting one or more of the variables of combustion air supply, RPM of the kiln, and green coke feed rate so as to keep the end temperatures at target value. Preferably, only two variables are controlled in order to follow the updated target values, and the procedure also includes adjustment of one or both of such selected variables in order to compensate, when necessary, for changes in the other variable. Efficiency, economy, and unusual facility and reliability of control are achieved.

15 Claims, 5 Drawing Figures

CALCINATION OF COKE

BACKGROUND OF THE INVENTION

This invention relates to the calcination of carbonaceous materials, particularly petroleum coke such as intended to provide carbon for making electrodes or the like. Carbonaceous materials contemplated by the invention, including petroleum coke, can also be defined as those having a volatile content up to about 15% and calcinable to a density of at least about 1.6 g/cc, for example, 2 g/cc or higher. Thus anthracite coal can be considered as example of such material, but ordinary bituminous coal is not.

Calcining operations of this sort are commonly performed in a rotary kiln into which the green petroleum coke in suitable particulate form is fed at or near one end, for delivery of treated product at the other end. In the kiln, the coke is calcined at high temperature, to drive off the volatiles and moisture and re-orientate the crystalline structure of the coke to a predetermined, desired degree. The calcined product is useful for carbon elements and structures, notably for various situations of electrical function, such as in high temperature electrochemical operations, and most particularly for anodes and lining compositions in aluminum reduction cells.

The calcining process requires adequate heating for a desirably high production rate of calcined coke, while at the same time the heating is very preferably achieved inside the kiln without substantial combustion of the carbon itself. As will be understood, the green, granular coke entering the feed end of the tubular kiln flows down the kiln at a rate depending mainly on the kiln slope, for example falling 0.5 inch per foot of run from feed end to discharge end, on diameter, for example from 6 to 15 feet, and on the kiln speed of rotation, for example in the range of 0.5 to 3 r.p.m.

Although much past practice has involved supplying at least the majority of the heat by firing with oil or natural gas burners into the lower end of the kiln, considerable success is possible using specially controlled procedure of a recent invention whereby all or most of the heat, after initial start-up, is provided by burning, inside the kiln, the combustibles constituted in the volatile material released in the operation. In earlier procedures, some heat was usually obtained by burning the released volatile substances, and in some instances provision was made for introducing air at places along the kiln to facilitate such burning. However, in accordance with the recent invention just mentioned, it has been found eminently feasible to derive most of the heat, indeed usually all of the heat, by burning the released combustibles with a supply of air forcibly introduced into one or more regions along a central zone of the kiln.

In the process just mentioned, effort is made, by determining the temperature of the discharging coke, and the place where the principal calcining operation is occurring (the coke bed being there in an expanded state), and also by determining from time to time the actual nature or quality of the calcined coke, to make adjustments as necessary to keep the calcining temperature at a selected, desirably high value, and to locate its maximum value at a desirable place lengthwise of the kiln, whereby the traveling coke takes a certain time to reach the discharge end from such maximum temperature locality, while it somewhat decreases in temperature. This mode of control has been found to achieve a stable and very useful operation, preferably requiring no other source of heat, and even leaving a considerable amount of unburned volatile material in the gases discharged at the coke feed end of the kiln. Such unburned gaseous material can be subjected to combustion elsewhere, for utilization of its energy.

It will be understood that in all operations with a rotary kiln, the coke travels down the sloping kiln while the gases, including the products of combustion of volatiles, and unburned gases, i.e. all supplied and developed gaseous materials (whether derived from air or volatiles), are exhausted through the coke feed end of the kiln, advantageously being withdrawn under some draft, such as may be developed at a locality where the remaining combustible material is burned.

As explained above, the desired result involves removing from the charge of green petroleum coke all moisture and nearly all volatile matter while at the same time (at least in part as a separate result of heating) altering the physical nature of the coke. More specifically, the desired physical change in the coke includes removal of moisture, as stated, and change in physical structure that may be measured as the increase of real density e.g. up to about 2.10 g/cc (grams per cubic centimeter) or likewise the improvement in average crystallite size up to about 35 Angstroms, it being understood that the mean crystallite thickness of green petroleum coke may be less than 18 Angstroms.

The invention mentioned above has provided substantial improvement in calcining of petroleum coke, with economy and stability, e.g. in delivering a high throughput of reasonably uniform product of good quality while avoiding appreciable combustion of the desired carbon content. As described below, the present invention affords even more accurate and efficient control, with simple primary reliance on measurements such as the discharging coke temperature (at the downstream end of the kiln), and the feed end temperature, being that of the gas there leaving the kiln.

These further improvements, involving further principles as well (preferably) as those developed in the previous invention, and indeed capable of practice (if desired) while utilizing the procedure of such invention, are designed to achieve greater accuracy and efficiency and to minimize departures from desired kiln conditions. Indeed, a special object is to insure that the desired target values of operating conditions, i.e. both those which are measurable and those which occur inside the kiln, are in effect known, or updated as may seem necessary from time to time.

More general objects of the invention are to provide fidelity and simplicity of control while attaining essentially zero fuel cost, increase of throughput, high uniformity of product and product, and unusual stability of operation.

SUMMARY OF THE INVENTION

In the present process for calcining petroleum coke or the like in a rotary kiln, a basic feature is the use, at least frequently, of readily measured temperature values, specifically (1) the temperature of the coke discharging or approach discharge from the kiln - conveniently here identified as the discharge end temperature, $T_d$ - and (2) the feed end temperature, $T_f$, which is determined in the exiting gases at the upper end of the kiln or just beyond such end, where the green coke is continuously fed. More specifically, the present invention affords an improved method whereby the kiln is controlled by the described measurements of discharge and feed end temperatures and by comparing them with desired target values, plus the operation of periodically updating or re-establishing such target values by determining and taking into account (*a*) the actual calcining zone location, $P_c$ (e.g. as observed in a visual manner through an end of the kiln), and (*b*) the actual physical constitution of the product coke, e.g. as measured by X-ray inspection, or density or other readings of samples of such product.

The invention basically contemplates that air for combustion of volatiles will be supplied along a longitudinally central region of the kiln and that the temperature of the traveling coke will rise to a maximum value (likewise at a longitudinally central locality), which can be taken to represent, and is therefore herein called, the calcining temperature, $T_c$, and will then decrease as the coke continues its descent to the end of the kiln. The primary controlling operation involves making adjustments, in a determinable manner as described below, of (1) the amount of air supply and (2) the rotation speed of the kiln (which governs the speed of travel of the coke), or of at least one of these, or alternatively or in addition to one or both, adjustments of rate of feed of green coke into the kiln, whereby desired target values of measured kiln conditions are maintained. Specifically advantageous procedure involves making such adjustments for corrective effect upon departure of one or both of the temperatures $T_d$ (discharge end) and $T_f$ (feed end) from target values. As indicated above, these target values are updated from time to time, indeed conceivably in some cases updated before every time they are used, by taking readings of the physical constitution of the calcined coke, i.e. density or the like, the observations of the actual position of the calcining zone, and determining whether there is departure from desired conditions. Such updating further includes determination, if necessary, of new or updated target values of $T_d$ and $T_f$ (or at least of $T_d$) which should be met in order to have the calcining zone in the correct place $P_c$ and to have the calcining operation reach a desired maximum temperature $T_c$.

Of particular significance in the above practice of the invention is the fact that actual readings of $T_c$ are not taken or directly needed, although this maximum temperature attained in the kiln is critically important for effective degree of calcining. That is, an effectively calcined state of a given coke, whether measured by crystallite thickness, real density, or otherwise, is specifically related to its reaching a particular maximum temperature required by such coke, e.g. at the end of its travel through what is herein called the calcining zone, being that part of the calcining actio wherein the coke is undergoing its final rise of temperature to such maximum.

Need is herein avoided for making such temperature measurements directly or even for knowing exactly what $T_c$ should be for a given coke, but the result is achieved that the operation is in effect controlled to assure that the coke reaches the correct maximum temperature. In the previous invention mentioned above, this result of $T_c$ control was also substantially achieved (e.g. by X-ray examination of the calcined coke, and by noting changes in discharge end temperature as indicating change in $T_c$), but the present process affords a specific, improved, very accurate mode of control for keeping $T_c$ at correct value. It will be understood that direct measurement of the calcining temperature is not ordinarily feasible, especially because of the desired location of the calcining zone deep within the kiln and because of the disturbed or turbulent or otherwise active nature of the kiln contents in such region as to prevent useful observation with pyrometers or similar devices.

By way of review of the foregoing, the invention contemplates relationships of target values for $T_f$ and $T_d$, corresponding to desired values of $P_c$ and $T_c$, which are readily determinable for a given kiln and operation, whereby adjustments of control variables (amount of air, kiln RPM, and/or coke feed rate) can be effected to maintain the target values.

As also stated above, a further feature of the process is that by readily made determinations from periodic observations of the calcining zone place, $P_c$ (e.g. by visual observation or by television), and from like periodic observations of the physical constitution of the product (e.g. crystallite thickness, $L_c$, by X-ray diffraction; or real density), representative of $T_c$, the target values of $T_f$ and $T_d$ are updated to any extent necessary. In this way, it is possible to control the operation with the greatest accuracy, i.e. to highly correct target values, for efficient maintenance of desired results.

An essential feature of operation for the process is the supply of at least the major quantity of combustion air, and preferably all or nearly all of it, at a longitudinally central locality of the kiln, for instance through a series of nozzles or tuyeres (e.g. three to ten) projecting through the kiln wall towards the transverse midpoint and spaced along a region that has its ends respectively spaced from the ends of the kiln. For instance, the furthest downstream nozzle may be at least one fourth of the kiln length from the coke discharge end and the furthest upstream nozzle at least the same distance, or preferably at least one third of the kiln length, from the coke feed end. The air is supplied forcibly, e.g. by blower or blowers or the like carried on the outside of the kiln, and its quantity, i.e. volume rate of flow, is controllable (in a range above a minimum) as by adjusting the blower or its inlet or outlet, or conceivably in another way, for instance by adjusting the draft out of the upper (feed) end of the kiln. It will be understood that the terms downstream and upstream are herein used as referring to the direction of longitudinal travel of the coke, e.g. in that downstream refers to the direction towards the coke discharge end. Likewise having regard to the slope of the kiln downwardly from the coke feed (and gas exhaust) end, references to directions or positions upward or uphill in the kiln mean direction or position toward the upper or coke feed end.

Basic principles in the significance of the temperatures $T_d$ and $T_f$ as indicative of the critical values $T_c$ and $P_c$ are that: an increase in $T_c$ leads to an increase in $T_d$ and theoretically also to an increase in $T_f$, although in some cases (for instance, because of heat reflection from the use of the exhaust gas by burning it at a place beyond the feed end) $T_f$ may be less or little sensitive to changes in $T_c$; and a movement uphill for $P_c$ produces an increase of $T_f$ but a decrease in $T_d$. Opposite changes in $T_c$ and $P_c$ generally yield reverse changes in $T_d$ and $T_f$.

The variables which are preferably controlled, namely the quantity of air, i.e. central air flow supplied and adjusted as above, for combustion of volatiles, and the rotation speed (rotations per minute, RPM) of the kiln, as directly governing the speed of the coke from feed to discharge, have basically the following effects on $T_c$ and $P_c$:

When the air is increased, $T_c$ tends to increase because more volatiles are turned. When air is decreased, the reverse phenomenon tends to occur. Simultaneously, these air changes can affect $P_c$, as defined in terms of the general location of the high-temperature region up inside the kiln, and in terms of the focus or sharpness of concentration of this high-temperature calcining region.

If $P_c$ is on target (at the air input location) or high, an increase in air will tend to move it up the kiln and de-focus it. If $P_c$ is low (a relatively rare occurrence), an increase in air will tend to help in re-establishing the desired position. If $P_c$ is high and/or de-focused, a decrease in air will tend to let it move down the kiln and become focussed, and in some ways help to boost $T_c$ (an effect contrary to that caused by a reduction of air). If $P_c$ is on target or low, a decrease in air may cause it to slip further down the kiln, to a less desirable position. As will be described below, this and other undesirable zone movement may be compensated for through correct action on the kiln speed, RPM.

It is noted that the concentration of the calcining zone is a matter to be considered, in that ordinarily it is desired to have the zone fairly concentrated or focused, as distinguished from being spread over a long distance along the kiln. It is particularly noted that there is a relationship between $T_c$ and the concentration of the zone, for example in that with increase in the concentration, $T_c$ increases, and vice versa.

Changes in speed of flow of coke down the kiln, achieved by variations in rotation speed of the kiln (RPM), are primarily related to shifting the calcination zone. If the zone is initially high (toward the coke feed end), and increase in RPM moves the zone down the kiln and also tends to concentrate or focus it. If the zone is on target or in a low position, however, increase in RPM is usually undesirable and may indeed lose the zone, so to speak, in moving it too far down. A decrease in RPM shifts the zone up the kiln; such shift tends to re-establish an initially low zone and to extend or spread a zone that is initially on target or high.

Insofar as changes in RPM modify the concentration (i.e. longitudinal spread) of the calcination zone as explained above, there will be a resulting effect on $T_c$, being the relationship of $T_c$ to zone focus or concentration that has also been explained.

If change of the feed rate of the coke, e.g. instead of change of RPM or in addition to such adjustment, is used as a control parameter, it is found that the calcining zone moves down the kiln upon an increase in feed rate, and up the kiln for a reduction in feed rate. There can be an accompanying spreading or contracting of the zone with such change in feed rate. In particular, such spreading or contracting depends on the initial position of the zone and is the same as that encountered when RPM is altered. An increase in the feed rate leads to a reduction in $T_c$ because more coke needs to be heated, and a decrease in feed rate may produce an increase in $T_c$.

DETAILED DESCRIPTION

Figure 1:
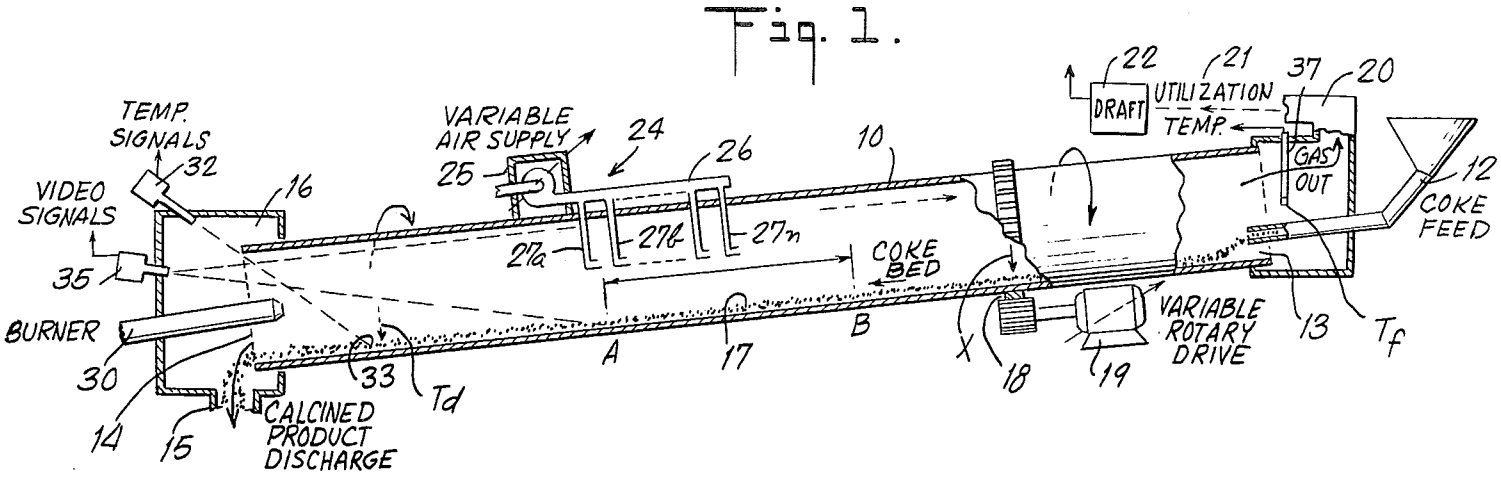
FIG. 1 is a diagrammatic view, showing a rotary kiln mostly in longitudinal vertical section and illustrating an example of operations and arrangements whereby an effective form of the invention can be carried out.

For illustration of the use of the invention, FIG. 1 shows a rotary kiln 10 into which granular petroleum coke is fed through an appropriate duct 12 at the upper, feed end 13 while the calcined coke is caused to be discharged at the opposite end 14 of the kiln, through an appropriate outlet 15 in a hood 16 which encloses the discharge end 14. The kiln is arranged with a downward slope, say ½ inch per foot, or more generally in the range of ¼ inch to 1 inch per foot, whereby the particulate coke under treatment travels as a continuous bed 17 along the inside bottom of the kiln, such travel being effected by rotating the kiln about its longitudinal axis, for example with a pinion and ring gear arrangement as at 18, having appropriate power driving means 19, such equipment being conventional, and being arranged for adjustment of speed of rotation, for instance within a range of 0.5 to 3.75 r.p.m., a suitable example being 2 to 2.5 r.p.m. for a kiln 8 feet in diameter.

Gases in the kiln flow countercurrently to the travel of the coke bed and are discharged at the feed end 13, for instance through suitable enclosure means 20 from which such gas, which ordinarily contains a useful content of unburned volatiles, is drawn to an appropriate locality for utilization as indicated at 21, preferably with the aid of suitable gas handling means or other draft control 22. The actual use of the discharged gases from the kiln is not a feature of the present invention, except for noting that although the invention preferably relies on burning only released volatiles for all of the heat of calcination, the discharged gases nevertheless usually contain remaining combustible values which may be recovered as heat.

As the coke bed travels from feed to discharge, it is subjected to high temperature, here developed by burning the combustibles with the aid of air introduced by supply means 24, which includes a fan or blower 25 delivering air through a suitable manifold 26 from which it is injected into the kiln by one or more openings or nozzles, conveniently an array of such nozzles or tuyeres **27*a*, 27*b*, etc., through 27*n*. These nozzles, for example, can be spaced axially or circumferentially along the kiln, directing the air upstream toward the gas outlet end, whereby the materials being volatilized from the petroleum coke are burned in order to generate the desired heat for the calcining operation, i.e. the heat which effects such volatilization and which causes the increase of real density of the coke. The air supply through the means 24 and its nozzles 27***a* to 27*n* is adjustable in amount, e.g. in cubic feet per minute, as by varying the speed of the fan 25 or otherwise controlling the air flow in this delivery system.

The initial operation of the kiln is brought about by supplemental heat, as with a burner 30 which projects into the discharge end for raising the coke bed to calcining temperature at the beginning. When such temperature is reached, and the released volatile materials have been ignited, the burner may be turned off. Heat from the combustion of volatiles can thereafter be relied upon for the entire calcining function in presently preferred operation.

While a variety of indicating and observing means may be employed, the drawing shows an optical pyrometer 32 arranged to inspect a locality 33 of the bed or adjacent interion kiln surface, conveniently near the discharge end 14. These temperature signals, which usually have best significance when taken as far up the kiln as possible, are designated herein as the discharge end temperature $T_d$, whether actually read at the discharge point or somewhat upstream as shown. $T_d$ is found to have a direct relation to the calcining temperature $T_c$, varying with it and being reliably significant of it when the downstream end of the calcining disturbance of the bed, or more specifically the downstream end A of the calcining zone, $P_c$, is situated at or returned to a preselected, desired place that is spaced inward of the end 14, e.g. as shown. In other words, it has been found that when all other conditions of the kiln (including $P_c$) are kept unchanged, or are compensated for (if changed), $T_d$ is an indicator of $T_c$, and specifically of changes in it, and correspondingly indicates changes in the physical constitution of the product.

The location of what is herein called the calcining zone is indicated by physical disturbance, e.g. disturbance of the bed, which is usually observable, from the end of the kiln, either by direct visual inspection or very conveniently by a suitable television camera 35 aimed at the coke bed in the vicinity of the air supply tuyere 27*a* which is situated farthest downstream.

As mentioned, it is found that through the most active region of the kiln, especially where the volatile materials, in gaseous state, are being evolved, the coke bed becomes characteristically disturbed, i.e. is more or less fluidized. Hence the location and existence of this disturbed, i.e. fluidized or floating region of the coke bed can be detected, in a kiln of the size and nature herein described for example, by the television camera 35, from which video signals are transmitted for display on a suitable screen observed by the operator of the kiln. Thus in at least many cases, the physical disturbance constituted by the fluidized state of the bed can be distinctly seen inside the kiln in that the bed is horizontal as if it were a liquid, in contrast to the normal appearance of the bed (e.g. downstream of the calcining zone toward and to the discharge end) with the advancing mass of coke particles carried angularly up the rising wall of the kiln.

Sometimes, however, conditions (for instance in very large kilns) prevent visual recognition of this fluidized or floating state of the bed. In such circumstances, observation of an equivalent physical disturbance can be taken to indicate the downstream end of the calcining zone and correspondingly the locality $P_c$. Such physical disturbance, indeed noted to some extent in all kilns operated in accordance with this invention, constitutes a body or wall-like mass of volatiles or flame or both, more or less filling the kiln crosswise at and at least somewhat upstream of the lower end of the calcining zone, but not appreciably noticeable downstream of the zone. Such physical disturbance can be considered an observable quantity, i.e. to determine whether the calcining zone is high, low, or substantially in its target locality, e.g. with its downstream end adjacent to the lowermost nozzle 27*a*. These observations, perhaps with the aid of observations of the inside kiln wall, may also be used to indicate the degree of focus of the zone, as previously described.

For use in the present invention, another value that is preferably measured at least at frequent intervals is the feed end temperature, specifically the temperature of the gases being drawn out from the end 13 of the kiln through the enclosure 20. While this temperature $T_f$ can be read inside the kiln, preferred operation has involved measurements with a thermometer element 37 in the enclosure 20, specifically sensing the temperature at a locality more or less central of the cross section of the kiln end, just beyond the latter. The thermometer element 37 can be a thermocouple or may be some other type of pyrometer.

As explained, the preferred, immediate target values employed for adjustments to maintain desired process conditions are the end temperatures $T_f$ and $T_d$, especially the latter, and in preferred practice these target values are updated, as frequently as desired or necessary, in accordance with the above determinations of the calcining zone position $P_c$ and also by determinations of the physical constitution of the coke.

Specifically, a basic purpose of calcination is to achieve at least a particular degree of calcination of the product, which may, for example, exhibit a substantially higher value of real density than is characteristic of the green coke. In point of fact, any of several different types of measurement may be utilized for determining the actual result of the calcining process in the discharged coke, although in a general and at least approximate sense, it can be considered that the aim of the process is to achieve desired, higher density. Indeed the measurements of certain other characteristics can be said to correspond to density values i at least this general way, particularly to indicate the extent or effectiveness of calcination of the coke.

Actual, direct determinations of real density of product samples can be made, but these are somewhat time consuming. Another physical property likewise related to density is electrical resistivity, which could thus be measured instead of density. Most conveniently, result-related determinations on samples can be made by X-ray diffraction (XRD) methods, for which suitable instruments are well known and which in the present case are utilized to measure average crystallite thickness. The crystallite thickness of the product coke is a preferred alternative to direct density measurement because it it more accurate and a more fundamental measure of changes in the coke structure. These values of average crystallite thickness are conveniently herein identified as $L_c$.

The measurements of physical constitution of the product, whether the values of $L_c$ or direct density values or the like, are very significant as indicating whether the actual value of maximum calcining temperature $T_c$, to which the coke has been subjected is at the desired level. If the physical result of calcination, so measured, is satisfactory, then the coke must have been subjected to a temperature $T_c$ which was sufficiently high and indeed correct, for the desired result. By the same token, changes in $L_c$ or the like, e.g. departures from optimum character of the product, are specifically significant of changes or departures from the required $T_c$, and in fact such changes can be numerically significant, even though the actual value of $T_c$ itself is not known, and does not need to be known.

As stated, there is a basic relation between measurements of $L_c$ and the density of petroleum coke. Thus whereas the green coke may have a density (grams per cubic centimeter) of less than 1.6, e.g. 1.4, and the corresponding $L_c$ values less than 20 Angstroms (A), desired values for calcined coke may be 2.0 g/cc to 2.10 g/cc, with corresponding $L_c$ values of 22 to 35 A. In practice, it is found that when the XRD measurement ($L_c$) of the product bed is on target, the maximum temperature of the coke is necessarily at desired value.

Figure 2:
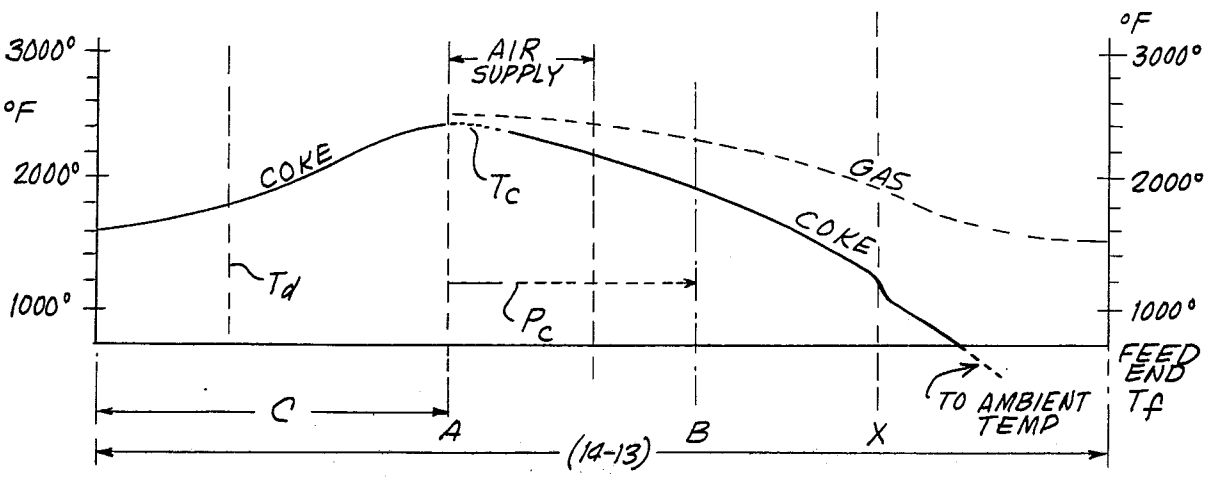
FIG. 2 is a graph roughly illustrating the longitudinal temperature profile of the coke, and (toward the feed end) the gas, along a kiln such as shown in FIG. 1, and on the same diagrammatic scale lengthwise, the profile being drawn in a simplified manner.

FIG. 2 is an example of a temperature profile, shown highly simplified, of the kiln shown in FIG. 1, which (also for example) may be assumed to be 200 feet in length (13 to 14, FIG. 1), 8 feet in diameter, sloping ½ inch per foot, rotating at a speed adjusted (according to the invention) in the vicinity of 2.5 RPM, and having a feed of green petroleum coke into the end 13 of about 25 tons per hour (t.p.h.). The tuyeres or nozzles 27 are distributed in this example, over a linear distance 27*a* to 27*n* of 20 feet or more (up to, say, 60 feet) beginning with the first nozzle 27*a* at a distance C of about one quarter of the kiln length or more (here 66 feet - i.e. upwards of 60 feet, even as much as 90 feet) from the discharge end 14. The total air supply may be adjusted as required for the present process, for example within a range of 7,000 to 15,000 c.f.m. (cubic feet per minute) or sometimes more.

Total residence time of coke in the kiln can usually be about 45 minutes or more. It is found that with the calcining zone having the desired location, especially for stable operation, the time required for the coke to travel from the tuyere 27*a* to the discharge end 14 is at least five minutes or more, and more often or preferably about 10 minutes or above, i.e. even as much as about 15 minutes.

Indeed, it may be considered that FIG. 2 represents, diagrammatically, the temperature conditions along the kiln, i.e. the locations of various conditions or actions in the kiln when the process is being performed in a desired manner, i.e. with various temperature and positional values occurring in agreement with the target values for them. Thus, for instance, with a representative kind of green petroleum coke, of more or less normal nature, the furthest downstream point of coke bed fluidization can be maintained at locality A (FIG. 1). This position, incidentally, is such that the coke will require from 10 to 15 minutes (e.g. a specific, stabilized time within that range) to travel on to the actual coke discharge end 14 of the kiln. The so-called discharge end temperature $T_d$, as read by pyrometer 32, may be kept at desired target value, which, purely for example here, might be determined to be about 1800° F. The output gas temperature, being the so-called feed end temperature $T_f$, might, for like example, have a target value of about 1600° F and, if found to be variable, can be kept at that target value.

Under such circumstances, i.e. with $T_d$ and $T_f$ on their targets and with $P_c$ situated along the area from A to B and also with the discharged product having desired physical constitution such as an $L_c$ value of over 22, the diagram of FIG. 2 represents conditions of the desired operation and result of the present process. Moreover, it can be considered, from other tests or studies, that the calcining temperature $T_c$, i.e. the actual value reached at the peak of the coke temperature curve in FIG. 2, may have a value of about 2400°, although as stated above the actual value of $T_c$ may not even have to be calculated for the present process. It may be noted that in this simplified indication of desired operating or target conditions in FIG. 2, the calcining zone is reasonably concentrated or focused, between points A and B (FIG. 1).

It is understood that in practice, as the coke moves down the kiln from the feed end 13, it reaches a temperature, as at locality X upstream of the so-called calcining zone, where gases, being volatiles, begin to be evolved. The intense calcining action, however, both in driving out volatiles and in increasing the density or equivalent physical composition of the coke, occurs within a desirably compressed or focused region AB. The actual location of maximum temperature $T_c$ is not critically established but is considered to occur usually in a part of the distance AB that is relatively close to the locality A, for example as indicated in FIG. 2.

The practice of the invention involves steps of measurement of various kiln operating characteristics, preferably in two phases, and then steps of corrective action, again preferably in two phases, as dictated by what may be called a basic strategy of kiln control. The ultimate objective is to maintain a preselected position and focus of $P_c$,i.e. the calcining zone, and most particularly a desired value of $T_c$, the calcining temperature, which is specifically the maximum temperature to which the coke is raised, and which is desired to occur in the calcining zone.

Figure 3:
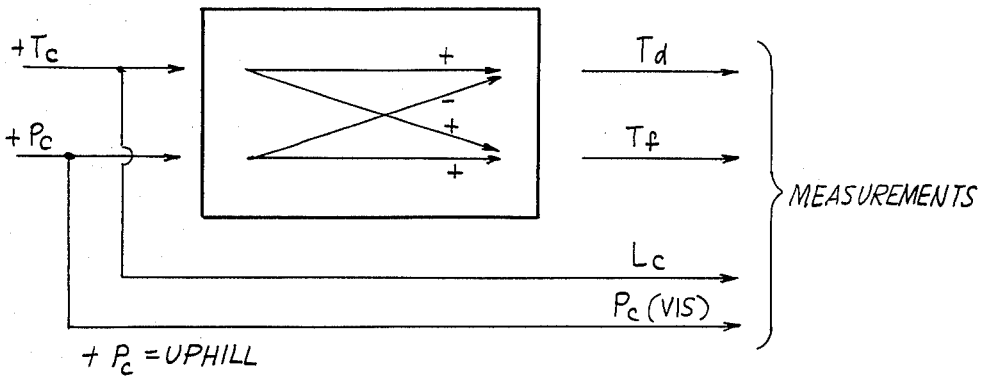
FIG. 3 is a diagram shown by way of representative example, to illustrate the manner in which various measurments useful in the invention are affected by changes in values of critically significant conditions inside the kiln.

The measurement steps have been outlined hereinabove, and are illustrated by diagram in FIG. 3, relating measured values to $T_c$ and $P_c$. As will be seen, the measured kiln-end temperatures $T_d$ and $T_f$ are governed by $T_c$ and $P_c$, the example being of positive increments, wherein a movement of $P_c$ uphill, i.e. upstream of the coke path, is regarded as positive. Such increases of $T_c$ can produce, in a complete sense but subject to possible lack of relation between $T_c$ and $T_f$ as explained above (such situation being readily accounted for, as will be understood, in empirical quantitative evaluation of these relations for a given kiln), increases in $T_d$ and $T_f$. Likewise positive movements of $P_c$, uphill, increase $T_f$ and decrease $T_d$. Opposite, i.e. correspondingly negative changes in $T_c$ and $P_c$ produce changes in $T_d$ and $T_f$ which are correspondingly opposite, i.e. reverse of the effects shown in FIG. 3.

At least at suitable intervals, more direct measurements are made relative to $T_c$ and $P_c$, the first being measurement of the physical constitution of the calcined coke product, preferably the crystallite thickness found by X-ray, called $L_c$, and the second being the visual measurement of the calcining zone, $P_c$, as explained above. Determinations of Lc are particularly important because they indicate whether the coke has been subjected to proper calcining temperature ($T_c$) whatever that proper temperature should be. Green coke properties (e.g. percent volatiles, moisture, particle size) may vary from time to time and correspondingly change the proper $T_c$ needed to produce optimum calcined coke; e.g. two different values of $T_c$ may be needed to produce the same desired value of $L_c$ for two different cokes. Hence the $L_c$ readings represent whether the existing $T_c$ is correct or insufficient (or even excessive) for the current coke and conditions, without anyone actually having to know or determine what the proper value of $T_c$ should be. Correspondingly, the target values for $T_d$ and $T_f$ can be maintained or updated to provide, in effect, the proper, desired $T_c$. In normal stable kiln operation, with feed coke of constant properties and stable ambient conditions, this updating feature may be required only very infrequently, as a fine tuning measure. Under less stable feed or ambient conditions it may be important that this feature be used more frequently as described below.

Figure 4:
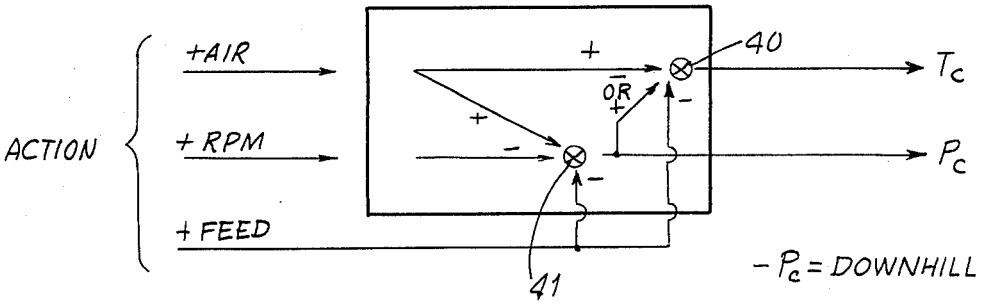
FIG. 4 is a diagram, also shown as representative example, to illustrate the manner in which various controlling operations or other changes affect the significant conditions within the kiln.

There are three principal actions that can be taken for kiln control, as diagrammatically indicated in FIG. 4, with their consequences on $T_c$ and $P_c$ that have also been outlined hereinabove. For example, these separate actions are illustrated as: (1) incremental changes in amount of air, e.g. as delivered by the blower 25, or by other control; (2) increments of rate of travel of coke, produced by changes in kiln rotation speed RPM; and (3) increments of coke feed rate, e.g. in tons per hour. In FIG. 4, the occurring values of $T_c$ and $P_c$ are shown by the marked circles 40 and 41, which of course have no positional or like significance. Plus and minus changes in $T_c$ are respectively increases and decreases, and plus and minus changes in $P_c$ are respectively movements of the zone uphill and downhill in the kiln.

It will be noted that the secondary effect of a modification of $P_c$ upon $T_c$ depends on the original location of $P_c$. Thus if change of RPM or of feed rate moves $P_c$ down from an initially high position, there is also a tendency to concentrate or focus the calcining zone and thereby to increase $T_c$; if $P_c$ moves away from its target position or becomes defocused, this may reduce $T_c$. Changes in feed rate of themselves independently affect $P_c$ and $T_c$ as shown in the diagram. As will be understood, if the sole actions actually and preferably utilized for control are changes of air and RPM, the diagram also shows the effects of feed rate change, as a guide for corrective steps to compensate for such feed rate change. As will also be understood from FIG. 4, reverse or opposite effects on $T_c$ and $P_c$ are occasioned by negative increments (rather than positive ones shown) of change in air, RPM and feed rate.

The basic process of the invention can be considered as the strategy for kiln control, including the steps of corrective action needed to maintain the desired value of calcining temperature $T_c$, whether quantitatively known or not, and the desired location of the calcining zone $P_c$. Specifically, the basic process first involves establishing and re-establishing target values for the end temperatures $T_d$ and $T_f$ by taking periodic measurements of $L_c$ or equivalent, and $P_c$, and correspondingly setting or re-setting the target values, by suitable conversion in accordance with FIG. 3 using calculated or precalculated relationships that can be easily developed, for example, from trial kiln measurements. As will be now understood, these relationships can be calculated utilizing suitable equations for which coefficients are developed from such test measurements, for example as set forth below.

Secondly, the process includes determining actual values of $T_d$ and $T_f$, on a continuous or at least as frequent a basis as the foregoing, and comparing such measurements with the target values to determine departures from the latter, requiring corrective action in order to return $T_c$ and $P_c$ to their desired levels.

Thirdly, the process involves performing steps of corrective action, i.e. by adjusting one or more, but preferably no more than two, of the variables represented by air supply, kiln rotation speed (RPM), and coke feed rate, to restore $T_d$ and $T_f$ to target values. A particularly effective operation embraces making adjustments only in one or both of air and RPM. In such case, the feed rate is assumed to be constant, but if changes occur in it, advantitiously or by design, the procedure further includes making adjustments in one or both of air and RPM, again in a direction to maintain or return $T_d$ and $T_f$ at or to target values. Such adjustments, intended to keep $T_c$ and $P_c$ at desired values despite changes in coke feed rate (which are then regarded as a disturbance), represent a control operation that can be characterized as feed forward as distinguished from feedback control involved by adjusting conditions, e.g. air and RPM, in response to departures in $T_d$ and $T_f$ from targets.

More generally, where any two of the three variables air, RPM and feed rate are employed for control action, the third can be considered as a disturbance when it occurs and can be determined quantitatively, with the same principles applied for feed forward control relative to such disturbance. As will now be understood, the foregoing steps of action in adjusting stated variables in accordance with feed forward and feedback control are achieved by suitable conversion in accordance with FIGS. 4 and 3 using calculated or precalculated relationships that can be readily developed, for instance, from trial actions and measurements in operation of the particular kiln in use. As will be appreciated, these relationships can be calculated utilizing suitable equations for which coefficients are developed from the test results for instance pursuant to illustrative explanation below.

To the extent necessary, the chain of relationships between measurements and control actions may include time delay functions, i.e. may include appropriate recognition of delay times, as in measured values relative to the value of $T_c$ in the kiln, and in responses by way of target updating and corrective actions. For instance, in practice of the invention with a specific kiln as described above, it appears that there can be a delay of about 15 minutes (one fourth hour) in the effect of a change in $T_c$ on $T_d$ and 30 minutes in the effect of such change on $L_c$. This latter delay is due to the fact that the sample for $L_c$ analysis can be taken only at the discharge from the cooling operation, which itself requires 15 minutes. Hence in simplified manual practice of the invention, for a target updating operation $T_d$ should be read 15 minutes before a sample is taken for $L_c$ measurement, and $T_f$ should be read and $P_c$ observed 30 minutes before such sample. In such practice, it is likely that another half hour will pass before the actual $L_c$ measurement by X-ray is reported to the kiln operator, but the relevant time delay consideration is with respect to the significance of $T_d$, $T_f$ and observed $P_c$, in coordination with the discharging calcined coke when a sample is taken at the cooler discharge. Indeed, very useful results are atainable with further simplification, by using the same time difference, e.g. making $T_d$, $T_f$ and $P_c$ readings all 15 minutes before taking the sample.

As will be appreciated, the relationships in the foregoing, as well as in the measurement operation where $T_d$ and $T_f$ are read and compared with the targets, and likewise in the controlling-action operation where changes in air and RPM are calculated as needed to correct departures from targets, are preferably treated as dynamic functions. That is to say, in rigorous consideration of calculations, there can be both pure time delay (in units of time) and an exponential time characteristic of the response, embodying a determinable time constant. On the other hand, particularly with a kiln where operation is normally quite stable, time delay or time response characteristics can be simplified. Examples of such simplification have been indicated above, and by way of further example, useful control can be achieved, for instance when manual control decisions are not made any more frequently than once per hour, without regard to time delay or function. That is to say, the dynamic effects can become practically negligible, for manual control purposes in response, through the use of suitably conservative control feedback loop strategy design. The changes of air and RPM needed to correct for off-target values of end temperatures can simply be found, as on the empirical basis explained above, without regard for time considerations.

The procedure is capable of practice by the manual attention of an operator who takes the readings and determines the corrective actions, or alternatively, the entire system is capable of automation, with the calculations and correctives determined by a computer or other device, all taking full account of dynamic considerations. Manifestly, partly manual and partly automated operation can be performed. Whereas computer-governed control can be relatively frequent in functioning, indeed essentially continuous in end temperature readings and in calculating control actions, manual operation is nevertheless highly effective even though rapid frequency of measurements and actions is not attained.

Thus for example, it appears that if control decisions and corresponding action are effected for bringing end temperature values back to their targets, for the real purpose of correcting $T_c$ or $P_c$ or both, it is usually sufficient to do so at periods of one half to one and one half hours, a highly useful example being making such decisions and effecting such control every hour. Although target updating can be considered as less frequent relative to the ultimate action decisions, and thus perhaps can be considered sufficient if achieved within every period of 1 to 2 hours or even less frequently, more frequent target updating may be useful. An example would be to update the target every hour or hour and a half and immediately thereafter to make a control decision based on whatever may be the departure, if any, of $T_d$ or $T_f$ or both from the updated targets. It will be understood, however, that a further importance of the utilization of target values for these temperatures and of controlling in accordance with the target values is that these temperatures are easy to determine, and can be available in a continuously determined manner. Hence the kiln operator may in a sense always know whether the temperatures are at least approximately on target and can know promptly when they have been restored to target after a corrective action. Furthermore, the same principles are advantageous even in automatic control, in that these temperatures represent continuously available control points for revealing both the condition of kiln operation and the results of measures for correcting errors in such operation.

The several calculations and conversions that deal with the interpretation of measurements, likewise with the operations of successively establishing sets of target values for $T_d$ and $T_f$, i.e. periodically updating the target values, and with the ultimate operations of adjusting the action variables, i.e. air supply at the region so marked in FIG. 2 (also herein simply identified as "air"), RPM (being the kiln rotation speed), or feed (if used as an alternative action variable for one of the others), and also adjusting the variables of air and RPM when feed changes represent a disturbance, can be determined by tests of the selected kiln with, for example, various sets of step changes in action variables and corresponding observations of measured quantities. The results can be developed in tabular, graphic or similar form, if desired, with appropriate account taken for time factors incident to the significance of measurements and to the effect of adjustments in action variables.

It has been found, moreover, that these relationships can be developed mathematically to yield expressions wherein numerical factors can be established, as from experimentally observed or theoretically derived data, for equations from which the significance of measurements and the nature of required actions, whether for updating targets or correcting kiln operation in response to departures from targets, can be readily calculated as necessary in actual performance of the kiln control process. A particularly advantageous mathematical development is set forth below, using adaptations of matrix-form descriptions and matrix-algebra analysis for linear time-invariant dynamical systems; it has been discovered that such mode of expression and operation is particularly appropriate and complete for present practical purposes in relation to measurement and control of a kiln for calcining petroleum coke. The nature of matrix expressions and equations, the various notations and symbols employed, including simplification of statements, likewise the use of various types of operators, transfer functions, inversions and the like are set forth in known and accepted manner, and will be readily understood by control engineers and indeed generally by workers in the art of dynamics of systems, especially in that this type of mathematical treatment is well recognized and used for system analysis and control.

The following example of parametric description of kiln measurement, action and strategy is therefore given chiefly in matrix form and notation. Positive and negative states of various changes, and the symbols for conditions, action and measurements are as explained hereinabove. Although other units and bases may be used, numerical evaluations are to be understood as temperatures in degrees F., time in hours, observed position of the calcining zone (called "visual" below), or $P_c$, in feet from the desired location as previously described, RPM as revolutions per minute, "air" as air supply through system 24 in FIG. 1 in cubic feet per minute, and "feed" as feed of green coke in tons per hour (tph). The development below is basically related to $T_c$ and $P_c$, as the underlying criteria of desired calcining treatment, of which $P_c$ is in effect directly observable; although $T_c$ is not directly measured or even actually selected for a given coke, the calculations are ultimately related to $L_c$ (or equivalent), for practical use. For simplification $L_c$, being the X-ray diffraction measurement of average crystallite thickness in the coke, can be understood here and in the claims as of generic significance (unless otherwise stated), i.e. to mean the physical constitution of the coke directly indicative of the extent of calcination, and thus to include equivalent measurements such as real density and electrical resistivity.

Dealing first with the measurement aspect (FIG. 3), basic equations for the significance of $T_d$ and $T_f$ are $$T_d = m_{11}T_c - m_{12}P_c \quad (1)$$
$$T_f = m_{21}T_c + m_{22}P_c \quad (2)$$

where $m_{ij}$ are coefficients to be quantified for each kiln either by experiment, as can be easily done, or preferably via known relationships to kiln specifications, raw material specifications, and the like.

Equations (1) and (2), taken together, may be written in the matrix form as $$\begin{bmatrix} T_d \\ T_f \end{bmatrix} = \begin{bmatrix} m_{11} & -m_{12} \\ m_{21} & m_{22} \end{bmatrix} \begin{bmatrix} T_c \\ P_c \end{bmatrix} \quad (3)$$

or more simply as $$\begin{bmatrix} T_d \\ T_f \end{bmatrix} = M \begin{bmatrix} T_c \\ P_c \end{bmatrix} \quad (4)$$

As will be understood, this is a 2 × 2 matrix system described by the simultaneous equations (1) and (2). Preferably, for rigorous treatment, equation (4) can involve dynamic aspects to account for time considerations, as by including appropriate transfer functions as proper elements of the matrix, e.g. using a conventional transfer function embracing both pure time delay in units of time and exponential step response as a function of a determinable time constant; the operator M can then be expressed as M(s), having reference to the general concept of the process input as $u(s)$ and output as $y(s)$, being related by a gain Function $g(s)$.

For purposes of establishing and re-establishing target values, the back-up measurements are given by $$L_c = m_{b11}\,T_c + OP_c \quad (5)$$
$$\text{visual} = O\,T_c + m_{b22}P_c \quad (6)$$

or in matrix form $$\begin{bmatrix} L_c \\ \text{visual} \end{bmatrix} = \begin{bmatrix} m_{b11} & O \\ O & m_{b22} \end{bmatrix} \begin{bmatrix} T_c \\ P_c \end{bmatrix} \quad (7)$$

or more simply $$\begin{bmatrix} L_c \\ \text{visual} \end{bmatrix} = M_b \begin{bmatrix} T_c \\ P_c \end{bmatrix} \quad (8)$$

Again preferably this equation can embrace a dynamic relationship, as with a similar transfer function relating to time, the expression $M_b$ being then written $M_b(s)$.

In reference now to the action aspect of the control operation (FIG. 4), and generally in relation to the control variables, the effect of the three actions on $T_c$ and $P_c$ can be written as:

$$T_c = g_{11}\,\text{Air} + g_{12}\,\text{RPM} + g_{d1}\text{Feed} \quad (9)$$
$$P_c = g_{21}\,\text{Air} + g_{22}\,\text{RPM} + g_{d2}\,\text{Feed} \quad (10)$$

or as $$\begin{bmatrix} T_c \\ P_c \end{bmatrix} = \begin{bmatrix} g_{11} & g_{12} \\ g_{21} & g_{22} \end{bmatrix} \begin{bmatrix} \text{Air} \\ RPM \end{bmatrix} + \begin{bmatrix} g_{d1} \\ g_{d2} \end{bmatrix} \text{Feed} \quad (11)$$

or more simply $$\begin{bmatrix} T_c \\ P_c \end{bmatrix} = G \begin{bmatrix} \text{Air} \\ RPM \end{bmatrix} + G_d\,\text{Feed} \quad (12)$$

Again G and $G_d$ can be dynamic operators, represented as G(s) and $G_d(s)$.

It should be noted: that the signs of the elements $g_{ij}$ depend on the details of the movements of the calcining zone, as explained above and indicated in FIG. 4; and that all the measurements and action relationships in all the foregoing equations are descriptive of increments about typical mean operating levels.

As an element of strategy or action, when feed changes are considered a disturbance, the control operation above described as feed forward can be developed from equation (12) in the following form:

$$\Delta \begin{bmatrix} \text{Air} \\ RPM \end{bmatrix} = -G(s)^{-1}\,G_d(s)\,\Delta\,\text{Feed} \quad (13)$$

where Δ is change in the particular parameters referred to. This calculates the simultaneous Air and RPM change needed to compensate or counterbalance the effect of the Feed Disturbance. Again, Air or RPM could have been regarded as the disturbance and the principle would remain the same.

Figure 5:
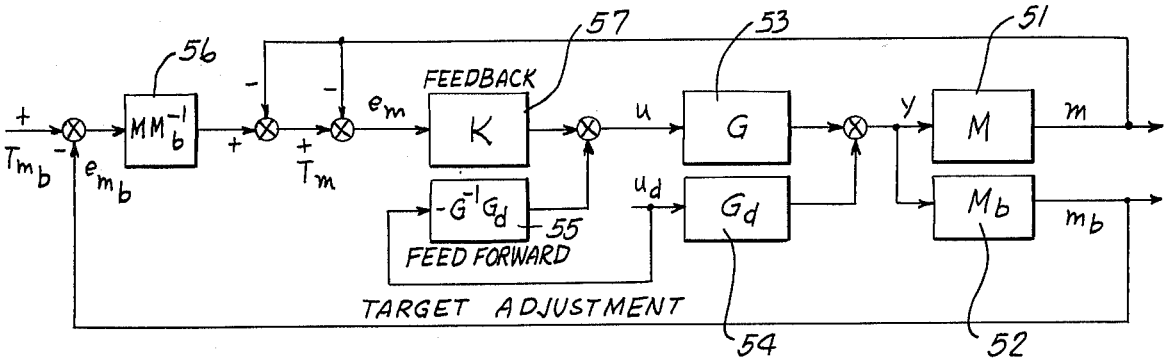
FIG. 5 is a mathematical diagram representing the layout of an example of overall control system for the invention.

At this point, reference may be made to the box diagram of FIG. 5 which illustrates mathematical operations or relationships involved in a practical example of the control procedure. This includes: the target adjustment operation (the $T_d$ and $T_f$ targets being identified generally as $T_m$); the feed forward operation wherein compensatory adjustment is made for changes in coke feed rate to the kiln; and the internal K feedback loop, involving control actions taken in response to departures of $T_d$ or $T_f$ of both from target values. In FIG. 5, the function of box 51 is described above in reference to equations (3) and (4), the function of box 52 in reference to equations (7) and (8), and the functions of boxes 53 and 54 in reference to equations (11) and (12). Similarly the function of box 55 is described in reference to the above equation (13). As will be seen in the description following, the function of box 56 is described hereinafter in reference to equations (15) below, and the function of box 57 in reference to equations (19) to (21) inclusive, also below.

As a primary element of the procedural steps, specifically as part of the control strategy, the end temperature target values are periodically established, i.e. regularly updated, on the basis of $L_c$ measurements and of visual observations directly related to $P_c$. This can be basically developed by the following mathematical sequence:

Take equation (8) in the dynamic form $$\begin{bmatrix} L_c \\ \text{visual} \end{bmatrix} = M_b(s) \begin{bmatrix} T_c \\ P_c \end{bmatrix} \quad (8)$$

and re-arrange to give $$\begin{bmatrix} T_c \\ P_c \end{bmatrix} = M_b(s)^{-1} \begin{bmatrix} L_c \\ \text{visual} \end{bmatrix} \tag{14}$$

Substitute the right-hand side of equation (14) for the values of $$\begin{bmatrix} T_c \\ P_c \end{bmatrix}$$

in equation (4) (dynamic form)

$$\begin{bmatrix} T_d \\ T_f \end{bmatrix} = M(s) \begin{bmatrix} T_c \\ P_c \end{bmatrix} \tag{4}$$

to give $$\begin{bmatrix} T_d \\ T_f \end{bmatrix} = M(s)M_b(s)^{-1} \begin{bmatrix} L_c \\ \text{visual} \end{bmatrix} \tag{15}$$

Equation (15) represents the basic relationship between measured values of $L_c$ and visual $P_c$, and the end temperatures $T_d$ and $T_f$. Taking the differences between target (desired) and actual values of equation (15) yields the following target updating or establishing equation:

$$\begin{bmatrix} T_d - T_d \text{ Target} \\ T_f - T_f \text{ Target} \end{bmatrix} = -M(s)M_b(s)^{-1} \begin{bmatrix} L_c \text{ Target} - L_c \text{ Value} \\ P_c \text{ Target} - P_c \text{ Value} \end{bmatrix} \tag{16}$$

wherein $T_d$ and $T_f$ standing alone, $L_c$ value, and $P_c$ value represent actual measured values. It is noted that this equation is expressed solely in measured and measurable quantities, e.g. independent of $T_c$.

A further, underlying step in the control strategy can be considered as the operation of diagnosing $T_c$ and $P_c$ problems, which is here treated, for example, as an expression for errors in $T_c$ or $P_c$ or both, in terms of observed errors in $T_d$ and $T_f$. Thus equation (4) may be rewritten as:

$$\begin{bmatrix} T_c \\ P_c \end{bmatrix} = M^{-1} \begin{bmatrix} T_d \\ T_f \end{bmatrix} \tag{17}$$

and $$\text{Error} \begin{bmatrix} T_c \\ P_c \end{bmatrix} = M^{-1} \text{ Error} \begin{bmatrix} T_d \\ T_f \end{bmatrix} \tag{18}$$

In practice, a time delay has to be included, for example a pure time delay, $e^{-0.25s}$, numerically one fourth hour in the example of a kiln described elsewhere herein. The time delay is required because $M(s)^{-1}$ by itself contains some phase advance terms, i.e. terms whereby in mathematical description there are output changes occurring before input changes. Stated in another way, the time delay function in effect removes the time advance in the $M^{-1}$ operator; for instance in the situation of $T_d$, the related fact is that the $T_d$ measure lags the $T_c$ and $P_c$ events up inside the kiln. Therefore equation (18) becomes:

$$\text{Error} \begin{bmatrix} T_c \\ P_c \end{bmatrix} = e^{-0.25s} M^{-1} \text{ Error} \begin{bmatrix} T_d \\ T_f \end{bmatrix} \tag{19}$$

which gives an estimate of $$\begin{bmatrix} T_c \\ P_c \end{bmatrix}$$

errors as they were 0.25 hours ago.

The final or ultimate step of the process comprises calculating and executing control actions, e.g. adjustments in air, RPM or both (or equivalent adjustments where coke feed is an action variable) in response to errors in $T_d$ and $T_f$, the last-named errors being departures of these temperatures, as measured, from target values. Following the scheme of directing the mathematical treatment to $T_c$ and $P_c$, equation (19) gives a representative relation of $T_c$ and $P_c$ errors to observed $T_d$ and $T_f$ errors, while the required action adjustments, e.g. as increments of change in air and RPM, that are required by the $T_c$ and $P_c$ errors, are readily developed (as will now be understood) from equation (12). By way of further explanation, the desired algorithn for determining actual control actions takes as its input the observation and measuring of $T_c$ and $P_c$ errors (from $T_d$ and $T_f$ errors) as determined above, and calculates the action adjustments, e.g. air and RPM, required to return the kiln to desired status of $T_c$ and $P_c$, or in practical terms to target values of $T_d$ and $T_f$. The detected errors should be corrected as quickly as possible without producing an unstable operation.

Predicated on the underlying relation between $T_c$, $P_c$ and air, RPM as embraced in equation (12) and adopting a control operator K for determination of the governing adjustments in air and RPM (including relationships previously expressed by G or $G^{-1}$), the implementation of action adjustment is developed as follows:

$$\begin{bmatrix} \text{Air} \\ RPM \end{bmatrix} = K(s) \text{ Error} \begin{bmatrix} T_c \\ P_c \end{bmatrix} \tag{20}$$

$$= K_c(s)K_d(s) \text{ Error} \begin{bmatrix} T_c \\ P_c \end{bmatrix} \tag{21}$$

where the operator $K_c(s)$ advantageously is a compensator which considers the interactive effects of air and RPM on both $T_c$ and $P_c$—a mathematical operation of known type which will now be understood and seen to be applicable here. This permits attainment of simultaneous control actions, if necessary, as for example by adjustment of both air and RPM to correct a departure of only one of $T_c$ and $P_c$ from desired condition without disturbing the other, or to correct errors of both.

As an example of applying the foregoing to a particular kiln in the calcination of petroleum coke of average characteristics, e.g. a kiln as described hereinabove, tests were performed to determine actual numerical values for the various proportions or conversion factors implicit in the measurement relationships of FIG. 3, and likewise such proportions or factors involved in the action diagram of FIG. 4. Step changes in air, RPM and feed rate, appropriate to determine effects of each independently of others and effects of changes of pluralities of these inputs, and output responses in values of $T_d$, $T_f$, $T_c$ and $P_c$ were measured, $T_c$ being taken, in sufficient manner, by frequent $L_c$ values of XRD samples, and $P_c$ by visual observation. With a background of general knowledge of behavior of kilns for calcining coke, e.g. for preliminary estimates, and by graphical and like analysis of the test results, parameters were developed for all of the action relationships indicated in FIG. 4 and then for all of the measurement relationships of FIG. 3. In so doing, as will to understood in the field of control technology, conservative evaluations were made, i.e. high steady-state gains, long time constants (exponential response) in the relations of air, RPM and feed to $T_c$ and $P_c$, and long time delays in the relations of $T_c$ and $P_c$ to $T_d$ and $L_c$ at the cooler discharge.

With the determined parameters (and by the use of conventional mathematical techniques, as will be readily understood), coefficients were established for the several matrix equations outlined above and solutions were developed to yield operating equations for ready calculation (in performance of the control process of the invention) as to: the direction and amount of changes in target values of $T_d$ and $T_f$ (relative to measured $T_d$ and $T_f$) in view of measured $L_c$ and $P_c$ (visual) when off their targets; the direction and amount of changes in air or RPM or both necessary to counteract changes in feed rate considered as disturbances; and the direction and amount of changes in air or RPM or both to restore kiln operating condition (which potentially involve off-target situations of $T_c$ or $P_c$, although not measured) to the desired state, specifically to correct off-target, measured values of $T_d$ or $T_f$ or both.

Referring to the example of a particular kiln mentioned above, the following are representative definitions of $K_c(s)$ and $K_d(s)$, including evaluation of coefficients in one of these from kiln tests:

$$K_c(s) = \begin{bmatrix} 300/60 & 0 \\ 2/1000 & -20/1000 \end{bmatrix} \begin{bmatrix} 1 & -4^*/(1+0.5s) \\ 0 & 1 \end{bmatrix} \tag{22}$$

$$K_d(s) = \begin{bmatrix} k_1(s) & 0 \\ 0 & k_2(s) \end{bmatrix} \tag{23}$$

In equation (22), the $-4^*$ remains $-4$ if the zone $P_c$ is low and moving up towards its target, but becomes $+4$ if the zone is high and moving down towards its ideal position. This occurs because movement of $P_c$ towards its target from either direction will tend to increase $L_c$ as previously described. In equation (23), $k_1(s)$ and $k_2(s)$ are functions designed to provide a compromise between speed of corrective response and stability against overshooting or the like. Very simply, this involves applying a safety factor to either or both of the action adjustments, e.g. at least the air adjustment, as by using an increment of adjustment which is only 0.7 to 0.9 of the value calculated, for such increment to be fully corrective; such safety factor of 0.8 can be very useful.

Considered more fully, the specific numerical values for parameters in $K_d(s)$ of equation (23) are readily determinable, being typical proportional-plus-integral (PI) controllers where:

$$k_i(s) = k_{Pi} + \frac{k_{Ii}}{S} \tag{24}$$

-continued with $k_{Pi} + K_{Ii} \leq 1.0$ (e.g. 0.7 – 0.9).

In this example, equation (13), which performs the step of feedforward reaction to feedrate disturbances, becomes $$\Delta \begin{bmatrix} \text{AIR} \\ \text{RPM} \end{bmatrix} = \begin{bmatrix} 250 \\ 0.02 \end{bmatrix} e^{-0.35} \Delta\text{Feed} \tag{13'}$$

where the factor $e^{-0.3s}$ means that the Air and RPM changes should be made about 20 minutes after the feed change.

Specifically, this means, for instance, that 20 minutes after a cook feed increase of 1 t.p.h., the air should be increased by 250 cfm (cubic feed per minute). Little or no RPM change is needed because the tendency of a feed increase to push $P_c$ down is counterbalanced by the tendency of central air increase to push it up.

Similarly, equation (16), which performs the target adjustment for the feedback control, outlined above, becomes $$\begin{bmatrix} T_d - T_d \text{ Target} \\ T_f - T_f \text{ Target} \end{bmatrix} = -\begin{bmatrix} 62\, e^{0.25s} & 0 \\ 46\, e^{0.5s} & 25 \end{bmatrix} \begin{bmatrix} L_c \text{ Target} - L_c \text{ Value} \\ P_c \text{ Target} - P_c \text{ Value} \end{bmatrix} \tag{16'}$$

where factors $e^{0.25s}$ and $e^{0.5s}$ indicate that adjustments to $T_d$ Target and $T_f$ Target should be based on the $T_d$ reading taken 15 minutes prior to taking the $L_c$ sample, the $T_f$ reading 30 minutes prior to the $L_c$ sample, and the $P_c$ determined 30 minutes before the $L_c$ sample is taken.

The re-conversion of $T_d$ and $T_f$ errors to equivalent $T_c$ and $P_c$ errors, as per equation (19) is accomplished by $$\text{error} \begin{bmatrix} T_c \\ P_c \end{bmatrix} = \begin{bmatrix} 0.52 & 0 \\ -0.03 & 0.04e^{-0.25s} \end{bmatrix} \begin{bmatrix} T_d \\ T_f \end{bmatrix} \tag{19'}$$

The feedback described by equations (20) to (24) then follows to complete the control calculations.

In the main, the parametric strategy described above can be considered a continuous-domain version, and thus characterized by its underlying applicability to automatic or any other type of operation, yet it can be easily convered to a sampled-data version employing a sampled-data analogue of the Laplace-transform techniques utilized above. As will now be understood, the foregoing concepts and relationships can be used to generate sampled-data versions in different forms at various levels of complexity and completeness depending on just how the control system is to be operated, i.e. manually or in fully automatic manner with or without aid of a computer, or with some combination of manual and automatic features.

In an example of actual working practice, the ultimate equations were found to be capable of simplification for easy but successful manual control of the kiln by operators, from knowledge, readings or determinations of $T_d$, $T_f$, $L_c$, $P_c$ (visual), and feed rate, to enable all necessary adjustments of air and RPM.

Thus for feed forward control, easy calculation of:

$$\begin{bmatrix} \text{AIR} \\ RPM \end{bmatrix} = \begin{bmatrix} 250 \\ 0.02 \end{bmatrix} e^{-0.3s} \Delta \text{ Feed} \quad (25)$$

For updating end-temperature targets, the following permits ready calculation:

$$T_d \text{ Target} - T_d = 40(L_c \text{ Target} - L_c) \quad (26)$$

$$T_f \text{ Target} - T_f = 40(L_c \text{ Target} - L_c) + 20\,(P_c \text{ Target-} P_c) \quad (27)$$

Although a somewhat more complex equation can be used as previously, with readings of $T_d$, $T_f$ and $P_c$ made, say, 15 and 30 minutes before the sample for $L_c$ is taken, equations (26) and (27) were found successful with all of these readings made at the same time as the sampling.

Finally, for the main or feedback control, and in view of the difference of parameters for governing effects (e.g. on $T_c$) in correcting $P_c$ whether it has to move downward from above ideal position or upward toward such position, the following can serve for calculation of amounts of adjustment of air or RPM or both, upon departure of $T_d$ or $T_f$, or both from target values:

If the calcining zone ($P_c$) appears too far up the kiln or is on target:

$$\Delta \text{ air} = \frac{160}{100}(T_d \text{ Target} - T_d) + \frac{60}{100}(T_f \text{ Target} - T_f \quad (28)$$

$$\Delta\, RPM = \frac{0.1}{125}(T_d \text{ Target} - T_d) - \frac{0.1}{200}(T_f \text{ Target} - T_f) \quad (29)$$

If the calcining zone ($P_c$) appears too far down the kiln $$\Delta \text{ air} = \frac{250}{100}(T_d \text{ Target} - T_d) - \frac{60}{100}(T_f \text{ Target} - T_f) \quad (30)$$

$$\Delta\, RPM = \frac{0.1}{125}(T_d \text{ Target} - T_d) - \frac{0.1}{125}(T_f \text{ Target} - T_f) \quad (31)$$

As used, these equations represent an example of the ultimate control or action step of the process. They are best used for taking such action about once an hour, when only minimal account needs to be taken of dynamic or time considerations, but they in effect include the safety or stabilizing factor of 0.8.

The invention results in an unusually economical process for calcining petroleum coke or the like, with minimal requirements of heat energy, minimal loss of carbon by combustion, low dust content in exhaust gases, very advantageously low temperatures for such exhaust and for discharged product, while permitting extremely convenient control, either manually or automatically, simply by the continuously and easily available kiln end temperatures (of great use, whether or not actual adjustments are made very frequently), subject only to the periodic updating or targets by readings that can be made periodically and do not involve the inconvenience that might characterize efforts to make such readings continuously.

As stated, the process can be very effectively practiced in most cases witout any supplemental heat, except for initial start-up employing the burner 35; this is essentially true with usual qualities of petroleum coke, at feed rates of the order of 25 tph, yielding a product having a density of the order of 2g/cc or more, or an $L_c$ value upwards of about 20. Generally, the invention is applicable as described to operations where upwards of 75% of the calcining heat is derived by burning released combustible volatiles, preferably at least 85%, more suitably 90% or more, but with unusual advantage where 100% of the heat is so obtained.

It is to be understood that the invention is not limited to the specific values, steps and examples herein described, but may be carried out in other ways without departure from its spirit.

We claim:

1. In a method of calcining coke which, while it is heated to calcine it, travels from the green coke feed end to the product coke discharge end of a sloping, rotary kiln at a speed variable with speed of kiln rotation, RPM, which method includes supplying 75% to 100% of the calcining heat by combustion of volatile material that is removed by heat from the coke, and effecting said combustion by controllably supplying air into the kiln along a longitudinal region spaced substantially from both discharge and feed ends while drawing gaseous combustion products upstream through the kiln and out the feed end, the heating of the coke being effective to raise the temperature of the traveling coke to a maximum value $T_c$ in a longitudinal calcining zone $P_c$ spaced from both kiln ends and desired to be situated at least about as far from the discharge end as said region, while the temperature of the coke decreases substantially during further travel to the discharge end, the improvement which comprises:

a. selecting as variables to be adjusted for control of calcination, two of the following: supply of air for combustion of volatiles, RPM of the kiln and green coke feed rate;

b. repeatedly establishing target values for kiln end temperatures respectively of coke at the discharge end, $T_d$, and of exhaust gas at the free end, $T_f$, to represent desired values of $T_c$ and $P_c$;

c. each step of establishing said discharge end and feed end targets comprising measuring values of $L_c$ in coke product samples, $P_c$ position, $T_d$ and $T_f$, which values to extent necessary are correlated in time with preceding passage of the coke of said sample through the calcining zone, determining departure, if any, of the value of $L_c$ from a value representing desired $T_c$, and of $P_c$ from desired value, and converting such $L_c$ and $P_c$ departures into departures of said $T_d$ and $T_f$ measurements from desired target values, for determining said desired target values;

d. at least periodically measuring $T_d$ and $T_f$, to determine departures thereof from the last-established target values of $T_d$ and $T_f$, and converting such departures of $T_d$ and $T_f$ into adjustments of one or both of said selected control variables for modifying the kiln operation so that the actual $T_d$ and $T_f$ values can change towards agreement with said last-established target values, whereby $P_c$ is maintained substantially in desired place and $T_c$ substanially at desired value for effective calcination of the coke.

2. A method as defined in claim 1, in which the variables selected to be adjusted for control of calcination are supply of air and RPM.

3. A method as defined in claim 2, which includes the step of converting changes in green coke feed rate into adjustments of one or both of said selected variables to counteract effect of said feed rate changes on kiln operation to maintain $P_c$ and $T_c$ as desired.

4. In a method of calcining coke which, while it is heated to calcine it, travels from the green coke feed end to the product coke discharge end of a sloping, rotary kiln at a speed variable with speed of kiln rotation (RPM), which method includes supplying 75% to 100% of the calcining heat by combustion of volatile material that is removed by heat from the coke, and effecting said combustion by supplying air int the kiln at an intermediate region spaced substantially from both said kiln ends while drawing gaseous combustion products upstream through the kiln and out the feed end, the heating of the coke being effective to raise the temperature of the traveling coke to a maximum value in a longitudinal calcining zone $P_c$ desired to have a predetermined situation spaced substantially from both said kiln ends while the temperature of the coke decreases substantially during further travel to the discharge end, said maximum value being desired to be a temperature for effectively calcining the coke as determinable by measurement of degree of calcination in the product coke, the improvement which comprises:

a. selecting as variables to be adjusted for control of calcination, at least two of the following: supply of air for combustion of volatiles, RPM of the kiln and green coke feed rate;

b. repeatedly establishing target values for kiln end temperatures respectively of coke at the discharge end, $T_d$, and of exhaust gas at the feed end, $T_f$, to represent desired effective calcination in the product coke and desired situation of $P_c$;

c. each step of establishing said discharge end and feed end targets comprising measuring values of degree of calcination in coke product samples, $P_c$ position, $T_d$ and $T_f$, which values to extent necessary are correlated in time with preceding passage of the coke of said sample through the calcining zone, determining departure, if any, of the value of degree of calcination from a desired value representing effectively calcined coke, and of the position of $P_c$ from desired value, and converting such degree of calcination and $P_c$ departures into amounts by which said $T_d$ and $T_f$ measurements depart from desired target values that represent effectively calcined coke and desired $P_c$ position, for determining and establishing said desired target values;

d. at least periodically measuring $T_d$ and $T_f$, to determine departures thereof from the last-established target values of $T_d$ and $T_f$, and converting such departures of $T_d$ and $T_f$ into adjustments of one or more of said selected control variables for modifying the kiln operation so that the actual $T_d$ and $T_f$ values can change toward agreement with said last-established target values, whereby $P_c$ is maintained substantially in desired position and said maximum temperature of the traveling coke substantially at desired value for effective calcination of the coke.

5. A method as defined in claim 4, in which the variables selected to be adjusted for control of calcination are supply of air and RPM.

6. A method as defined in claim 5, which includes the step of converting changes in green coke feed rate into adjustments of one or both of said last-mentioned selected variables to counteract effect of said feed rate changes on kiln operation so as to maintain $P_c$ in desired position, and said maximum temperature at desired value.

7. A method as defined in claim 4, in which the position of $P_c$ is determinable by physical disturbance in the kiln which extends along the interior of the kiln substantially no further downstream than such position, said measurements of $P_c$ position being effected by detecting the position of said physical disturbance.

8. A method as defined in claim 7, in which the detection of position of said disturbance is effected by visual observation.

9. A method as defined in claim 4, in which the calcining zone is characterized by a visually observable expanded or fluidized condition of the traveling coke bed in the kiln, extending substantially no further downstream than the downstream limit of $P_c$, and the step of measuring value of $P_c$ position includes detecting of said expanded or fluidized coke bed by visual observation.

10. A method as defined in claim 9, in which the coke is petroleum coke containing about 7% to 13% entrained, combustible, volatile material, and in which upwards of 85% of said calcining heat is supplied by combustion of removed volatile material.

11. In a method of calcining carbonaceous material of the character described, while it is heated to calcine it, travels from the green material feed end to the product material discharge end of a sloping, rotary kiln at a speed variable with speed of kiln rotation (RPM), which method includes supplying 75% to 100% of the calcining heat by combustion of volatile material that is removed by heat from the carbonaceous material, and effecting said combustion by supplying air into the kiln at an intermediate region spaced substantially from the kiln ends while drawing gaseous combustion products upstream through the kiln and out the feed end, the traveling carbonaceous material being heated to a maximum temperature value in a longitudinal calcining zone $P_c$ desired to be spaced substantially from both kiln ends, said maximum value being desired to be a temperature for effective calcination of the carbonaceous material, the improvement which comprises:

a. selecting as variables to be adjusted for control of calcination, two of the following: supply of air for combustion of volatiles, RPM of the kiln and green carbonaceous material feed rate;

b. repeatedly establishing target values for kiln end temperatures respectively of carbonaceous material at the discharge end, $T_d$, and of exhaust gas at the feed end, $T_f$, to represent desired kiln conditions;

c. each step of establishing said discharge end and feed end targets comprising measuring degree of calcination in carbonaceous product samples, $P_c$ position, $T_d$ and $T_f$, determining departure, if any, of the measured degree of calcination and the position $P_c$ from desired values, and converting such measured departures into departures of said $T_d$ and $T_f$ measurements from desired target values, for determining said desired target values;

d. at least periodically measuring actual $T_d$ and $T_f$, to determine departures thereof from the last-established target values of $T_d$ and $T_f$, and converting such departures of $T_d$ and $T_f$ into adjustments of one or both of said selected control variables for modifying the kiln operation to restore the actual $T_d$ and $T_f$ values toward agreement with said last-established target values, for maintaining effective calcination of the carbonaceous material.

12. A method as defined in claim 11, in which the variables selected to be adjusted for control of calcination are supply of air and RPM.

13. A method as defined in claim 12, which includes the step of converting changes in green carbonaceous material feed rate into adjustments of one or both of said selected variables to counteract effect of said feed rate changes on kiln operation, for maintaining effective calcination of the carbonaeous material.

14. A method as defined in claim 12, in which the carbonaceous material is petroleum coke and substantially all of the calcining heat is supplied by combustion of removed volatile material.

15. A method as defined in claim 11, in which the carbonaceous material is petroleum coke.

* * * * *

UNITED STATES PATENT AND TRADEMARK OFFICE

CERTIFICATE OF CORRECTION

PATENT NO. : 4,022,569

DATED : May 10, 1977

INVENTOR(S) : FRANK JOHN FARAGO, DALE GORDON RETALLACK and RAMAN RADHA SOOD

It is certified that error appears in the above-identified patent and that said Letters Patent are hereby corrected as shown below:

Column 1, line 13, "as " should read -- an --.

Column 2, line 55, "product" (first occurrence) should read -- production --.

Column 3, line 36, "the" (first occurrence) should read -- and --.

Column 3, line 55, "actio" should read -- action --.

Column 5, line 6, "turned" should read -- burned --.

Column 5, line 19, "focussed" should read -- re-focussed --.

Column 6, line 10, "surments" (word portion) should read -- surements --.

Column 7, line 18, "interion" should read -- interior --.

Column 8, line 45, "i" should read -- in --.

Column 14, line 45, "system" should read -- systems --.

Column 16, line 44, "of" should read -- or --.

Column 19, line 10, "to" should read -- be --.

Column 19, line 30, "condition" should read -- conditions --.

Column 20, line 10 (Equation 13'), "$_e$-0.35" should read -- $_e$-0.3s --.

Column 21, line 28 (Equation 28), "$T_f$" (last occurrence) should read -- $T_f$) --.

Column 21, line 62, "witout" should read -- without --.

Column 22, line 56, "towards" should read -- toward --.

UNITED STATES PATENT OFFICE

CERTIFICATE OF CORRECTION

Patent No. 4,022,569 Dated May 10, 1977

Inventor(s) Frank John Farago et al.

It is certified that error appears in the above-identified patent and that said Letters Patent are hereby corrected as shown below:

Column 22, line 59, "stanially" (word portion) should read -- stantially --.

Column 23, line 8, (Claim 4), "int" should read -- into --.

Column 24, line 16 (Claim 9), "the position" should be inserted after "ing" and before "of said".

Column 24, line 24, (Claim 11), "which," should be inserted after "described," and before "while".

Column 26, line 3 (Claim 14), "claim 12" should read -- claim 13 --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*